US005351624A

United States Patent [19]

Ahlborn et al.

[11] Patent Number: 5,351,624

[45] Date of Patent: Oct. 4, 1994

[54] BOGIE FOR HIGH-SPEED RAIL VEHICLES

[75] Inventors: Günter Ahlborn, Siegen; Guido Bieker, Kirchhundem; Gerhard Kampmann, Netphen; Alfred Lohmann, Siegen, all of Fed. Rep. of Germany

[73] Assignee: ABB Henschel Waggon Union GmbH, Berlin, Fed. Rep. of Germany

[21] Appl. No.: 29,025

[22] Filed: Mar. 10, 1993

[30] Foreign Application Priority Data

Jul. 10, 1991 [DE] Fed. Rep. of Germany ..... 4122741

[51] Int. Cl.[5] ..... B61F 5/00

[52] U.S. Cl. ..... 105/185; 105/198.1; 105/199.1; 105/199.3; 105/207

[58] Field of Search ..... 105/182.1, 185, 190.2, 105/193, 197.05, 198.1, 199.1, 199.3, 199.4, 190.1, 453, 207

[56] References Cited

U.S. PATENT DOCUMENTS

| | | | |
|---|---|---|---|
| 2,235,362 | 3/1941 | Eksergran et al. | 105/190.2 |
| 2,255,619 | 9/1941 | Janeway | 105/190.2 |
| 2,317,399 | 4/1943 | Nystrom et al. | 105/190.2 |
| 2,831,440 | 4/1958 | Lich | 105/198.1 |
| 3,200,771 | 8/1965 | Dobson et al. | 105/198.1 |
| 3,826,202 | 7/1974 | Russell-French | 105/198.1 |
| 4,538,525 | 9/1985 | Jackson et al. | 105/190.2 |

*Primary Examiner*—Mark T. Le

*Attorney, Agent, or Firm*—Herbert L. Lerner; Laurence A. Greenberg

[57] ABSTRACT

A bogie or truck for high-speed rail vehicles or railway cars includes an H-shaped bogie or truck frame, primary springs cushioning the bogie frame, and a lateral bolster being movable relative to the bogie frame, receiving a coach or car body and being cushioned relative to the bogie or truck frame by air springs. The object is to provide a bogie with a low number of contact points with the coach body, which allows a configuration for rotational retardation, which has a minimum structural width and low weight, which permits small air spring bellows, which allows the installation of additional air reservoirs for the air springs below the lateral bolster and which has additional assemblies disposed at locations which keep the bearing components free from bending or torsional stresses. According to the invention, each air spring is supported directly on the side wall of the bogie frame. The lateral bolster carries friction plates on its upper surface near its transverse ends above its bearing on the air spring for supporting the coach body. The lateral bolster is movable relative to the bogie frame only vertically and horizontally transversely within a defined path and is guided horizontally in the longitudinal direction with play in guides of the bogie frame. The lateral bolster is connected to the coach body through a journal which transmits only horizontal forces, and can be freely rotated with the bogie frame relative to the coach body.

1 Claim, 6 Drawing Sheets

BOGIE FOR HIGH-SPEED RAIL VEHICLES

CROSS-REFERENCE TO RELATED APPLICATION

This application is a continuation of International application Ser. No. PCT/EP92/01253, filed Jun. 5, 1992, now document No. WO 93/01076.

SPECIFICATION

The invention relates to a bogie or truck for high-speed rail vehicles or railway cars having an H-shaped bogie frame, primary springs cushioning the bogie frame relative to axles and a lateral bolster being vertically and horizontally transversely movable relative to the bogie frame, receiving a coach or car body of the rail vehicle, being cushioned relative to the bogie frame by pneumatic secondary springs (air springs), and being provided with rotational retardation.

Nowadays, some bogies or trucks for high-speed rail vehicles or railway cars are provided with an air spring disposed as a secondary spring in order to interrupt the transmission of structure-borne sound between the bogie and the coach body on one hand, and to obtain optimum suspension comfort in addition to the level compensation of the coach body which is made possible under different loading conditions, on the other hand. It is disadvantageous in the bogies of such a construction which are known in practice that the coach body generally rotates relative to the bogie within the air spring, which produces an unfavorable shear stress of the air spring bellows and adversely affects the suspension, produces undesirably high restoring forces in curves and necessitates large air spring bellows. Additionally, a multiplicity of coupling points are required between the coach body and the bogie, which causes high production costs, much time being required for exchanging the bogie, and increased structure-borne sound transmission. In the bogies which have a bolster disposed between the coach body and the bogie and the air spring being disposed between the lateral bolster and the bogie frame, although rotation within the air spring is partially avoided, the expenditure for components for the configuration of the air spring within the bogie is very high and unfavorable and the expenditure for the required rotational retardation elements is uneconomical.

Bogies for high-speed rail vehicles require a high expenditure with regard to achieving the required running stability. In particular in the bogies which are equipped for achieving a high running performance with wheelsets having an "anti-wear" profile, in addition to the required vertical and transverse dampers and roll supports, rotational retardation means must also be provided which impede the swaying of the bogie. Such rotational retardation means usually have a complex hydraulic construction and are provided with too much freedom of movement, as well as being relatively susceptible to breakdown and thus presenting a safety risk.

A bogie of the type mentioned is known, for example, from German Published, Non-Prosecuted Application DE 26 11 924, corresponding to U.S. Pat. No. 4,278,030. In that case, a center bearing is disposed centrally on the lateral bolster. The center bearing receives the coach body and guides the bogie horizontally relative to the coach body. The lateral bolster is mounted through air springs at its transverse ends on bolster spring planks which are suspended by means of pendulums on the outer longitudinal girders of the bogie. The bolster spring planks and the lateral bolster are connected to one another by means of connecting rods disposed in an articulated manner transversely to the bogie. The disadvantages in that construction are the suspension of the lateral bolster by means of spring planks and pendulums on the frame of the bogie, which suspension is complicated and expensive in terms of manufacture, the reduced effect of the rotational retardation between the bogie and the coach body, since the longitudinal connecting rods are too flexible, and the high bending resistance required of the lateral bolster due to the load of the coach body being introduced centrally through the center bearing, which leads to a high weight of the lateral bolster.

In the construction disclosed in German Published, Non-Prosecuted Application DE 23 37 771, corresponding to U.S. Pat. No. 3,988,92, the bolster is mounted directly on the lateral longitudinal girders of the bogie frame through sliding blocks. Disposed between the lateral bolster and the coach body on the upper surface of the lateral bolster are air springs which are attached at their upper surface below the coach body. The lateral bolster is connected to the coach body so as to be vertically movable through linkages which prevent rotation of the lateral bolster relative to the coach body and thus deformation of the air spring. The weight of the coach body acting directly through the lateral bolster on the sliding blocks on the side walls of the bogie frame in that case advantageously causes a rotational retardation of the bogie relative to the lateral bolster and thus also relative to the coach body. However, in addition to the problematic accessibility and complex assembly of the bogie with its air springs and the linkage for actuating the lateral bolster on the coach body, the disadvantage in that construction is the required additional configuration of a push-pull element which connects the bogie frame to the coach body. A further disadvantage is the low configuration of the sliding blocks in the vicinity of drifting snow and whirling up dust which adversely influence the effect of the rotational retardation.

It is accordingly an object of the invention to provide a bogie for high-speed rail vehicles, which overcomes the hereinafore-mentioned disadvantages of the heretofore-known devices of this general type, which has a low number of contact points with the coach body, which allows the possibility of a redundant and yet simple configuration of rotational retardation means, which has a minimum structural width and low weight, which permits small air spring bellows, which allows the installation of additional air reservoirs for the air springs below the lateral bolster, which has additional assemblies disposed in a clear or easily observed manner and at locations which keep the bearing components free from bending or torsional stresses, and which can be mounted or exchanged in a simple and timesaving manner below the coach body.

With the foregoing and other objects in view there is provided, in accordance with the invention, a bogie for high-speed rail vehicles, comprising an H-shaped bogie frame having axles, longitudinal girders and cross girders, the cross girders having guides and sliding or side frictional blocks in the guides; primary springs cushioning the bogie frame relative to the axles; a lateral bolster for receiving a coach body of the rail vehicle; pneumatic secondary air springs each being supported directly on the side wall or the longitudinal girder of the bogie frame for cushioning the lateral bolster relative to the bogie frame; means including tilting torsional shafts for retarding rotation of the lateral bolster; the lateral bolster having an upper surface, transverse ends, and a bearing on the air springs; friction plates disposed on the upper surface near the transverse ends above the bearing of the lateral bolster for supporting the coach body; the lateral bolster being movable relative to the bogie frame only vertically and horizontally transversely within a defined path and being guided horizontally in the longitudinal direction by the tilting torsional shafts with play through the sliding blocks; and a king pin or journal for connecting the lateral bolster to the coach body and for transmitting only horizontal forces, the king pin being geometrically freely rotatable with the bogie frame relative to the coach body.

Due to the fact that each air spring is supported directly on the side wall of the bogie frame, the bogie frame is advantageously not subjected to additional bending moments which occur in the case of a substantially eccentric application of force relative to the side wall. The configuration of the friction plates on the lateral bolster takes place approximately on the same basis as the air spring support relative to the bogie frame, so that bending Stresses of the lateral bolster from the coach body support are only subsidiary, as a result of which a weight-saving construction of the central part of the lateral bolster is made possible. Due to the fact that the bolster is movable relative to the bogie frame only vertically and horizontally transversely within a defined path, free rotation of the bogie relative to the coach body is permitted without lateral deformation of the air spring. In addition to avoiding unacceptably large restoring forces from the air spring, the installation of small-volume air springs is made possible. The structural width of the bogie is advantageously reduced. In addition to the mentioned free rotation of the bogie relative to the coach body, the connection of the bolster to the coach body through a journal transmitting only horizontal forces allows an easy possibility of mounting and exchanging the bogie below the coach body.

In accordance with another feature of the invention, the lateral bolster is limited horizontally in its movements in the longitudinal direction of the bogie through guide elements near to its transverse ends in guides of the bogie frame. The flexible guiding of the lateral bolster in the longitudinal direction of the bogie guarantees the desired longitudinal uncoupling of the bogie frame relative to the coach body. As a result, the excitation of coach body deflection vibrations is kept low, with the swaying of the bogie with the lateral bolster relative to the coach body being impeded at the same time through the rigid rotational retardation.

In accordance with a further feature of the invention, the lateral bolster is formed of a central part with a lateral bolster head at each of its transverse ends, connection elements for a longitudinal bolster stop, a lateral bolster stop, a vertical bolster stop and a vertical damper of the bolster and the connection elements for roll support, rotational retardation, air spring control valve, air spring and the rotational retardation sliding blocks of the bogie are integrated in the bolster heads.

This construction of the lateral bolster according to the invention guarantees that all external forces occurring at high speeds are transmitted from the bolster heads through its guides directly into the bogie frame without the central part of the lateral bolster being substantially stressed in terms of torsion or bending.

In accordance with an added feature of the invention, rotational retardation means are disposed on each side of the lateral bolster, each rotational retardation means are formed of a torsional shaft being disposed parallel to the lateral bolster, being mounted in a flexible manner on the lateral bolster heads by vertical journals disposed fixedly at their longitudinal ends, and, through connecting rods, mounted spherically at their ends, being connected, likewise spherically mounted, to the longitudinal ends of the longitudinal girders of the bogie frame.

In addition to guaranteeing high running reliability even upon failure of one rotational retardation means, this double configuration of the rotational retardation means allows longitudinal uncoupling between the bogie and the coach body and very high running speeds.

In accordance with a concomitant feature of the invention, there is provided an additional air reservoir disposed on each side below the lateral bolster for each air spring, each additional air reservoir being provided with a short and large-diameter connecting line to the respective air spring, and each additional air reservoir being attached to the lateral bolster through a bracket. Due to the short connecting lines, a rapid and even response of the air springs is achieved under all loading conditions. Due to the configuration of the additional air reservoirs on the lateral bolster, the additional air reservoirs are cushioned in a secondary manner and advantageously kept free from high frequency accelerations.

In total, a track-friendly bogie is provided by the invention using wheelsets with an anti-wear profile, which bogie is distinguished by low weight, very quiet running, absolute running safety, simple functioning, a clear or accessible configuration of the additional components and low stress of the individual components as well as easy exchangeability.

Due to the configuration of the essential functional elements on the lateral bolster heads, cavities for the configuration of additional equipment are provided in the central region of the bogie. Due to the small width of the bogie, the rotation openings of the outer casing of the coach body can advantageously be kept small.

Other features which are considered as characteristic for the invention are set forth in the appended claims.

Although the invention is illustrated and described herein as embodied in a bogie for high-speed rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
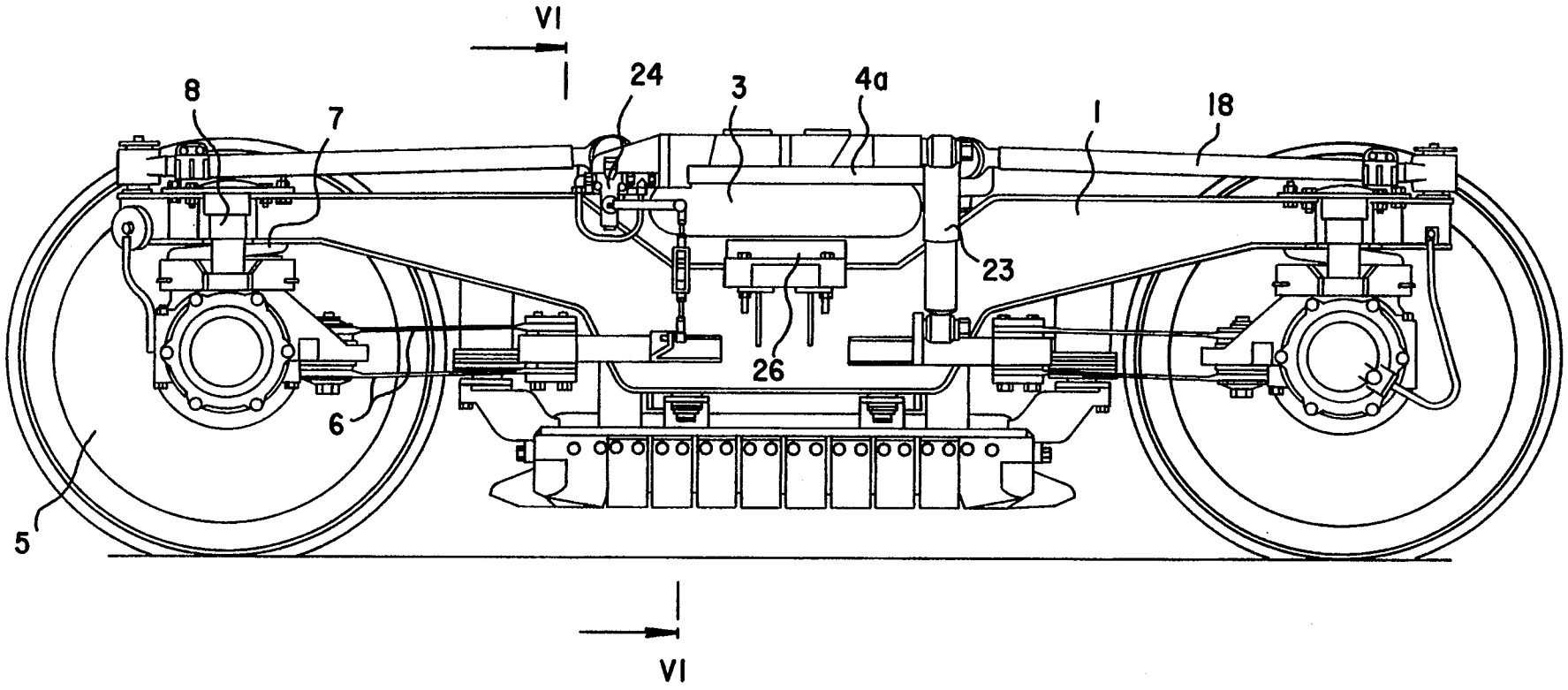
FIG. 1 is a diagrammatic, side-elevational view of a bogie according to the invention.
Figure 2:
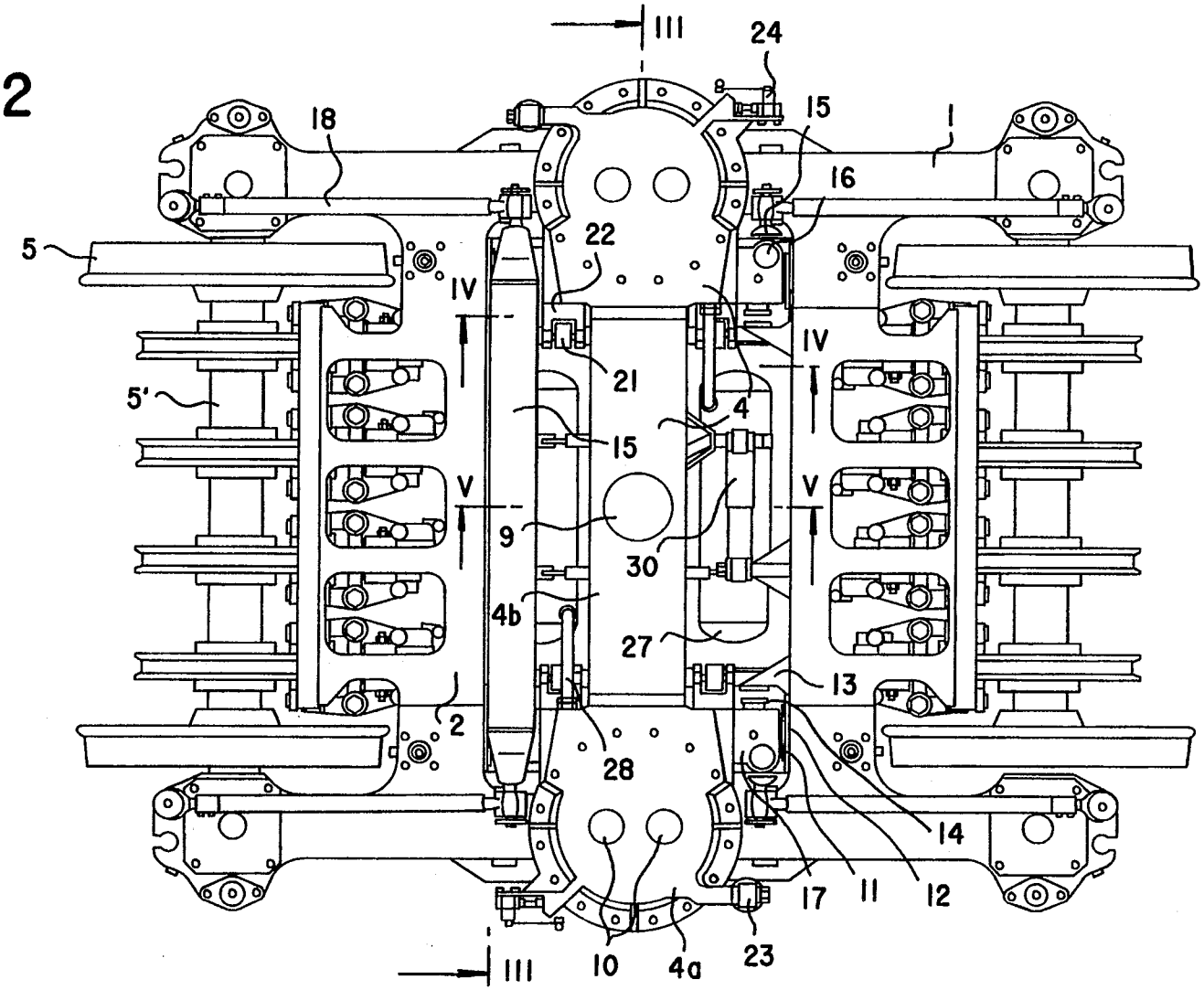
FIG. 2 is a plan view of the bogie according to FIG. 1.

Referring now to the figures of the drawing in detail and first, particularly, to FIGS. 1 and 2 thereof, there is seen an approximately H-shaped bogie or truck frame which is formed essentially of two longitudinal girders 1 and two cross girders 2 that interconnect the longitudinal girders 1 and are fixedly welded thereto. The longitudinal girders 1 are recessed downwards in the longitudinal center thereof to receive an air spring 3 approximately centrally on upper beams thereof. The upper and lower beams of the longitudinal girder 1 have no welded-on parts serving for the transmission of force. This measure serves the purpose of providing for a lightweight construction of the bogie frame. A lateral bolster 4 that is formed of lateral bolster heads 4*a* and a lateral bolster central part 4*b*, is mounted by the lateral bolster heads 4*a* on the air springs 3. The air spring 3 has a lower part which is attached on the longitudinal girders 1 and an upper part which is attached below the lateral bolster heads 4*a*.

Wheel sets 5 of the bogie or truck are guided on the longitudinal girder 1 by spring leaf connecting rods 6 and they are spring-mounted on the longitudinal girder 1 by primary springs 7 and shock absorbers 8.

The lateral bolster central part 4*b* has a box-type construction, is tapered towards the lateral bolster heads 4*a* and is provided centrally with a king pin guide 9, mounted in rubber, for a king pin, bogie pin or truck center pin of a coach or car body. The lateral bolster heads 4*a* are expediently manufactured from castings or forgings or in a mixed construction of forged and welded parts and are welded onto the lateral bolster central part 4*b*. Friction plates 10 are disposed on the lateral bolster heads 4*a* above the air spring 3 for receiving correspondingly constructed counter-bearings on the coach body. In this case, the vertical load of the coach or car body is directed through the friction plates 10, the lateral bolster heads 4*a* and the air springs 3 directly into the longitudinal girder 1 of the bogie or truck frame. The friction plates 10 interact with the counter-bearings below the coach body to serve for friction-rotational retardation. Torsional or bending stress of the longitudinal girder 1 is avoided by the direct introduction of the load of the coach body through the friction plates, the lateral bolster heads 4*a* and the air spring 3 into the longitudinal girder 1 of the bogie frame. Direct contact connection between the coach body and the bogie exists only through the friction plates 10 for receiving the vertical load and the king pin guide 9 for receiving the horizontal guiding forces of the coach body.

The lateral bolster 4 is mounted on the longitudinal girder 1 of the bogie frame through the air springs 3. The lateral bolster 4 is guided horizontally in the longitudinal direction of the bogie with slight play through sliding or side friction blocks 11 in guides 12 of the cross girders 2 of the bogie frame. The guides 12 are of flexible construction and are disposed on the cross girders 2 of the bogie frame. The bolster 4 is guided in the horizontal transverse direction on the air springs 3 with the required pendulum play between counter-bearings 13, which are disposed on the cross girders 2 of the bogie frame, with its transverse play being limited by lateral bolster stops 14 disposed on the bolster heads 4*a*. The lateral bolster stops 14 are of flexible construction with a progressive spring characteristic.

Figure 6:
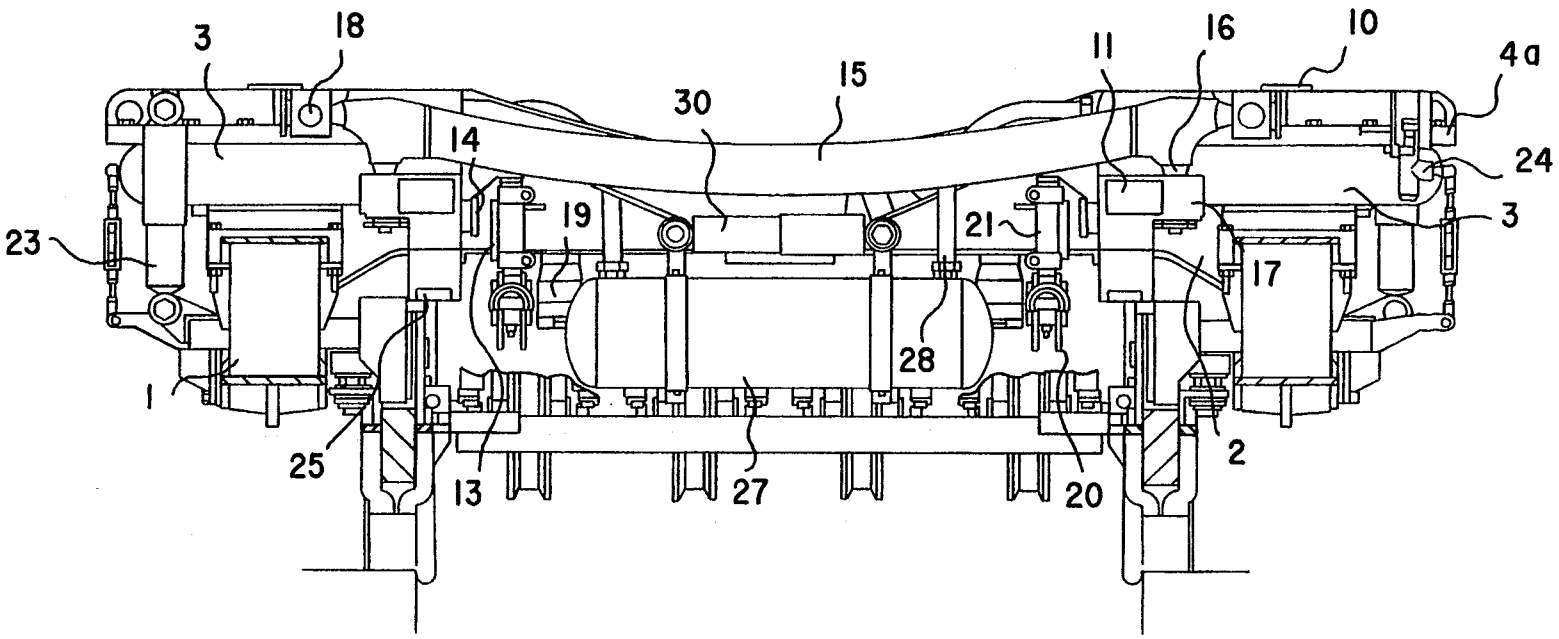
FIG. 6 is a sectional view taken along the line VI—VI of FIG. 1, in the direction of the arrows.

A torsional shaft 15 is disposed on each longitudinal side of the lateral bolster 4 for rotational retardation. In this case, each torsional shaft 15 is mounted at longitudinal ends thereof pointing vertically downwards through bearing journals 16 which are fixedly disposed with a spacing in a flexible manner in bearing lugs 17 of the lateral bolster head 4*a*, best seen in FIG. 6. In each case a connecting rod 18 is mounted spherically at each longitudinal end of each torsional shaft 15. Another end of each connecting rod 18 is connected and likewise spherically mounted to a respective longitudinal end of the longitudinal girder 1 of the bogie frame. The torsional shaft 15 of the rotational retardation means guarantees a longitudinal play between the lateral bolster 4 and the cross girders 2 of the bogie frame and thus longitudinal uncoupling of the lateral bolster 4 from the bogie frame. Therefore, rotation retarding means 15 to 18 are disposed on each side of the lateral bolster 4. However, when the lateral bolster 4 rotates relative to the bogie frame, this rotation is impeded by the rotational retardation (torsional shaft). When the bogie frame is rotated relative to the coach body, the lateral bolster and the bogie frame form a rigid structure due to the rotational retardation and largely impede swaying of the bogie. Due to the double configuration of the rotational retardation means on both sides of the lateral bolster, great rigidity against rotation which is necessary at high speeds and an increase in the running safety are guaranteed.

Figure 3:
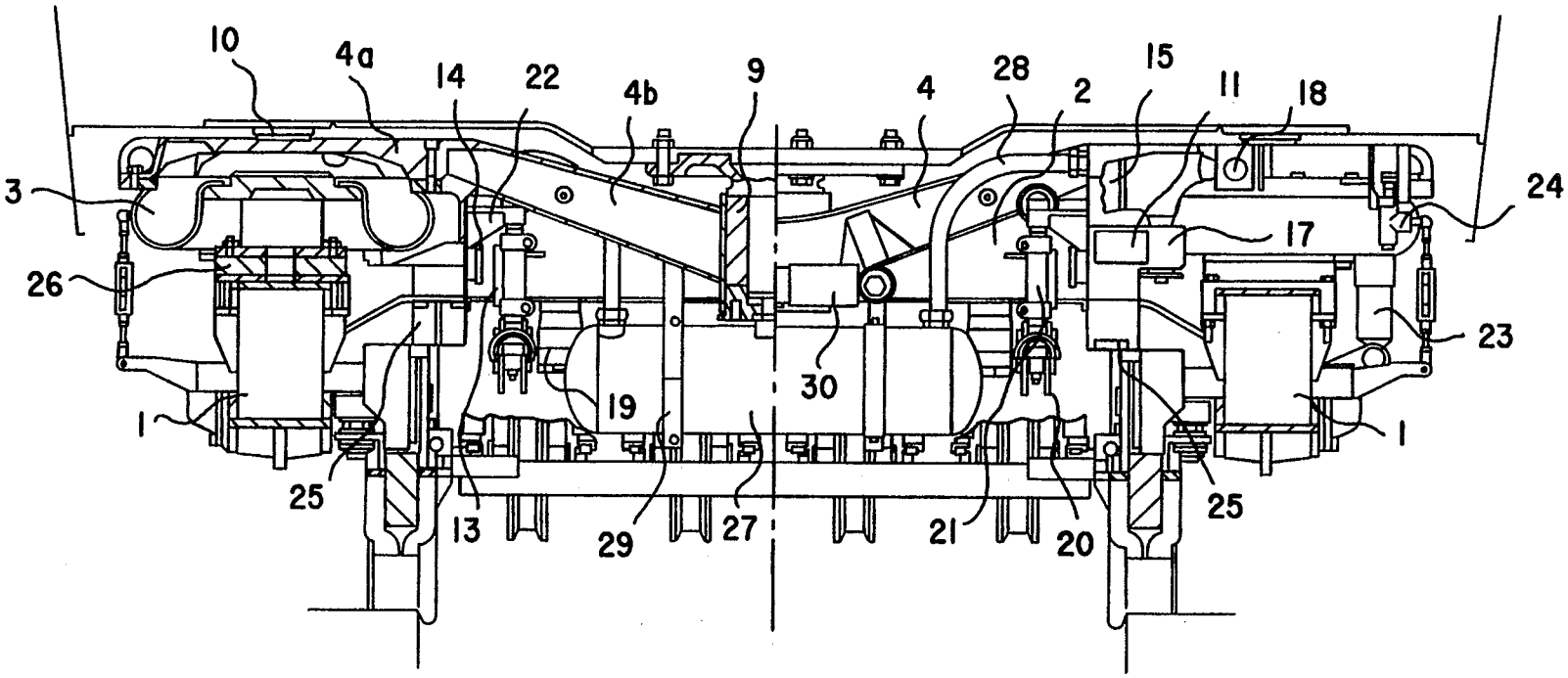
FIG. 3 is a sectional view taken along the line III—III of FIG. 2, in the direction of the arrows, which is shown in a rotated position.
Figure 4:
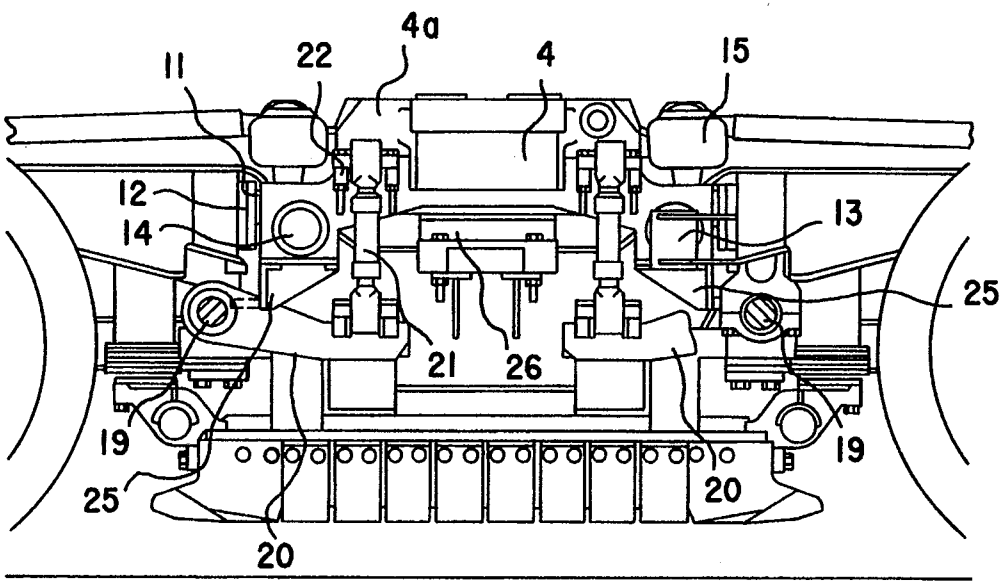
FIG. 4 is a sectional view taken along the line IV—IV of FIG. 2, in the direction of the arrows.

Furthermore, in each case the lateral bolster 4 is secured against rolling of the coach body by a roll support 19–22 disposed on both sides of the lateral bolster. The parts of the roll support are best seen in FIGS. 3 and 4. In this case, each roll support is formed of a torsional shaft 19 which is mounted rotatably below the cross girder 2 of the bogie frame. In each case a lever 20 is fixedly disposed at each end of each torsional shaft 19. A free end of each lever 20 spherically bears a pendulum 21 that has an end which is likewise mounted spherically on a bearing 22 of the lateral bolster head 4*a*. In the case of uneven deflection of the air spring 3, the torsional shaft 19 is twisted and rolling of the lateral bolster 4 is thus impeded.

Furthermore, in each case a vertical damper 23 is mounted spherically on the bolster heads 4*a*. Another end of the vertical damper is likewise spherically mounted on the longitudinal girder 1 of the bogie frame. Each lateral bolster head additionally has connections for an air spring control valve 24. Lateral bolster dampers 30, which are mounted spherically on the cross girder 2 of the bogie frame or on the lateral bolster 4, additionally damp transverse movements of the lateral bolster. Upper and lower vertical stops 25 and 26 bound the spring path of the lateral bolster 4.

The lower vertical stop 26 is a rubber spring element and it also serves as a secondary emergency spring in the case of pressure failure in the air spring, since the load from the coach body only is completely conducted off at this point.

Figure 5:
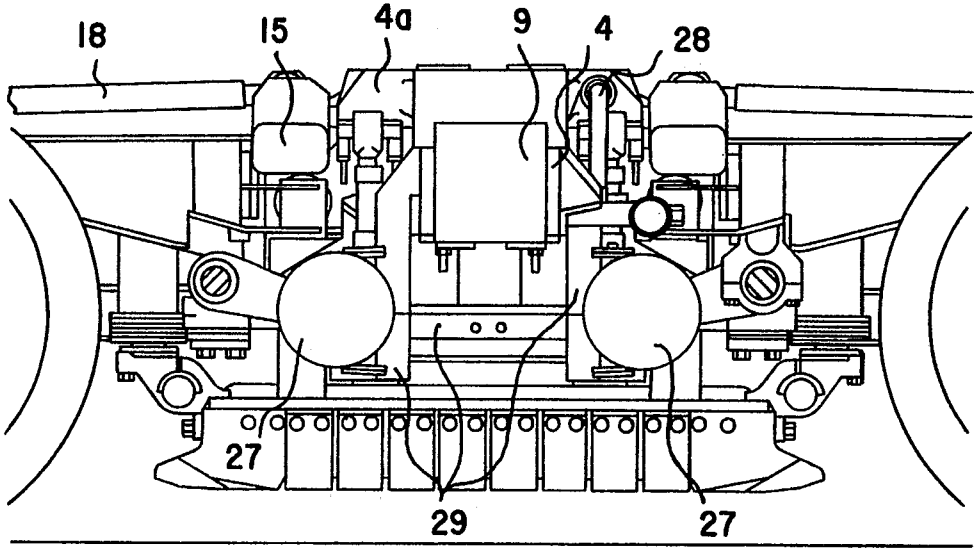
FIG. 5 is a sectional view taken along the line V—V of FIG. 2, in the direction of the arrows.

As is seen in FIGS. 3 and 5, in each case an additional air reservoir 27 for each air spring 3 is disposed on the lateral bolster 4 on both sides below it. Each additional air reservoir 27 is provided with a short and a large-diameter connecting line 28 to the respective air spring 3. In this case, each additional air reservoir 27 is attached to the lateral bolster 4 by a bracket 29, so that the additional air reservoir 27 and the lateral bolster 4 are cushioned in a secondary manner and high-frequency accelerations of the additional air reservoirs are avoided.

We claim:

1. A bogie for high-speed rail vehicles, comprising:

an H-shaped bogie frame having axles, longitudinal girders and cross girders, said cross girders having guides and sliding blocks in said guides;

primary springs cushioning said bogie frame relative to said axles;

a lateral bolster for receiving a coach body of the rail vehicle;

pneumatic secondary air springs each being supported directly on said longitudinal girder for cushioning said lateral bolster relative to said bogie frame;

means including tilting torsional shafts for retarding rotation of said lateral bolster;

said lateral bolster having an upper surface, transverse ends, and a bearing on said air springs;

friction plates disposed on said upper surface near said transverse ends above said bearing of said lateral bolster for supporting the coach body;

said lateral bolster being movable relative to said bogie frame only vertically and horizontally transversely within a defined path and being guided horizontally in the longitudinal direction by said tilting torsional shafts with play through said sliding blocks; and a king pin for connecting said lateral bolster to the coach body and for transmitting only horizontal forces, said king pin being geometrically freely rotatable with said bogie frame relative to the coach body;

said lateral bolster having a central part with a lateral bolster head at each of said transverse ends, and including connection elements for a longitudinal bolster stop integrated in said lateral bolster head, a lateral bolster stop disposed on said lateral bolster head, upper and lower vertical stops for limiting a spring path of said lateral bolster and a vertical damper mounted on said bolster head, and connection elements for roll support, retardation, an air spring control valve each integrated in said lateral bolster head, and said air spring and said friction plates of the bogie being integrated in said lateral bolster heads; and wherein said longitudinal girders of said bogie frame have longitudinal ends, said rotation retarding means are disposed on each side of said lateral bolster, and each of said rotation retarding means includes one of said torsional shafts being disposed parallel to said lateral bolster and having longitudinal ends, vertical bearing journals being fixedly disposed at said longitudinal ends of said torsional shafts for flexibly mounting said torsional shafts on said lateral bolster heads, and connecting rods being mounted spherically at said longitudinal ends of said torsional shafts for mounting and connecting said torsional shafts to said longitudinal ends of said longitudinal girders.

* * * * *